US006904264B1

(12) United States Patent
Frantz

(10) Patent No.: US 6,904,264 B1
(45) Date of Patent: Jun. 7, 2005

(54) METHOD REQUESTING AND PAYING FOR DOWNLOAD DIGITAL RADIO CONTENT

(75) Inventor: Gene A. Frantz, Missouri City, TX (US)

(73) Assignee: Texas Instruments Incorporated, Dallas, TX (US)

( * ) Notice: Subject to any disclaimer, the term of this patent is extended or adjusted under 35 U.S.C. 154(b) by 593 days.

(21) Appl. No.: 09/713,736

(22) Filed: Nov. 15, 2000

Related U.S. Application Data

(60) Provisional application No. 60/172,891, filed on Dec. 21, 1999.

(51) Int. Cl.[7] ..... H04H 1/00

(52) U.S. Cl. ..... 455/3.04; 455/407; 455/412.2; 709/217

(58) Field of Search ..... 455/3.04, 407, 455/412.2, 344, 45, 42, 3.01, 3.02, 3.03, 3.05, 3.06, 558, 557; 4551/66.1; 709/217; 370/313, 325, 316, 486

(56) References Cited

U.S. PATENT DOCUMENTS 5,303,393 A * 4/1994 Noreen et al. ..... 455/3.02
5,819,160 A * 10/1998 Foladare et al. ..... 455/45
5,898,680 A * 4/1999 Johnstone et al. ..... 370/316
5,914,941 A * 6/1999 Janky ..... 370/313
5,959,945 A * 9/1999 Kleiman ..... 381/81
6,563,805 B1 * 5/2003 Ma et al. ..... 370/325
6,658,232 B1 * 12/2003 Johnson ..... 455/3.06

* cited by examiner

*Primary Examiner*—Tilahun Gesesse
(74) *Attorney, Agent, or Firm*—Robert D. Marshall, Jr.; W. James Brady, III; Frederick J. Telecky, Jr.

(57) ABSTRACT

The user receives a digital radio transmission through a digital receiver and transmits a request to download selected content from this transmission to a content agent, an entity responsible for authorizing the authorized downloading of the digital content. If the content is not free of charge, the user also transmits sufficient information to allow for payment for the digital. The user then receives a transmission authorizing the downloading of the digital content from the content agent upon acceptance of the payment by the content agent. The user then downloads the content to a storage device which is coupled to the receiver.

12 Claims, 2 Drawing Sheets

METHOD REQUESTING AND PAYING FOR DOWNLOAD DIGITAL RADIO CONTENT

This application claims priority under 35 USC §119(e) (1) of Provisional Application No. 60/172,891, filed Dec. 21, 1999.

TECHNICAL FIELD OF THE INVENTION

The present invention relates in general to the field of digital transmission of digital content, and more particularly, to a system and method for transmitting and exchanging payment information for digital radio content.

BACKGROUND OF THE INVENTION

Digital radio, or digital audio broadcasting (DAB), is a method for transmitting digital quality audio signals to digital radio receivers. In-Band On-Channel (IBOC) transmission is a broadcasting technology characterized by the transmission of digital signals in the existing AM and FM spectrum and according to existing station assignments. A digital radio transmission scheme that uses IBOC transmission can be expected to deliver compact disc quality sound at the existing FM radio dial positions. Similarly, a digital radio system that uses IBOC transmission for AM radio can be expected to deliver FM quality sound.

IBOC digital radio transmission involves generating a digitally modulated signal that will exist on the same frequency as an existing analog station. Several digital modulation schemes are available. For example, audio sub-band digital coding techniques can be used to compress the digital content of the signal to fit within the frequency mask of each station frequency. Audio coding algorithms or schemes can also be based on acoustic measurements as a method for identifying those portions of the audio transmission that are inaudible to the is human ear and need not be transmitted As a result, the coding algorithms can sample the signal and delete the inaudible portion, thereby permitting significant audio compression and conservation of bandwidth without degrading audio quality. Because of the data compression of the coding algorithms, the compressed signal can occupy the available bandwidth of the AM and FM spectrums. In this manner, the available bandwidth can be used as a data channel.

A plot of a frequency mask as a function of power (dB) versus frequency (Hz) is wider at the bottom than it is at the top. Because a digital signal can be transmitted at lower power than an analog signal, the digital signal can occupy the wider, bottom part of the frequency mask without interfering with adjacent stations or signals. For example, the FM IBOC digital radio signal can occupy the sidelobes of the FM mask and the analog FM signal can occupy the frequency space between these sidelobes. In the case of AM radio, the AM IBOC signal can employ frequency separation and quadrature modulation to avoid interference with the analog AM signal.

Advantages of digital transmission for audio include better improved quality, less noise, and, a wider dynamic range, as compared with existing AM and FM radio. In addition to improved audio quality, IBOC digital audio broadcasting also provides for the transmission of data. Although FM subcarriers are now used to deliver data for many applications, IBOC digital audio broadcasting subsystems can accommodate larger amounts of data with greater reliability. Furthermore, prior to IBOC digital audio broadcasting, there has been no such capability in the AM band. Since the data may be audio or video, potential applications for data include station data such as call sign, format, artists and song titles, as well as music videos, images, news, financial and stock market data, paging, e-mail, dispatching, computer communications, and networking However, digital radio still possesses some of the shortcomings of traditional AM/FM radio. The user of a digital radio receiver can listen to or view the content of a digital radio transmission only at the time the content is being broadcast and only in the location where the user has physically placed the digital radio receiver. Not only is the user of a digital radio receiver limited in terms of the location in which he may listen to or view digital radio content, but he may only hear or view a portion of the available content depending on the time when he tunes his receiver to the selected channel. These shortcomings can be addressed by exploiting the advantages presented by digital radio's use of a digital, rather than analog, signal, namely, the ease of transmitting and storing digital information or content.

With the development of digital transmission and storage of music, video and other content, the owners of such content have become increasingly concerned with copyright infringement for several reasons. In a digital environment, content can be transmitted in digital quality from one entity to the next without any degradation in quality. Therefore, a need has arisen for a system which exploits the advantages of digital radio in conjunction with digital storage devices, while providing adequate protection for the copyright interests of digital radio content providers.

SUMMARY OF THE INVENTION

In accordance with the present invention, a method is provided which substantially eliminates or reduces disadvantages and problems associated with digital piracy while allowing the user to conveniently exploit the benefits of digital radio and digital storage devices.

According to the teachings of the present invention, the user is associated with a digital receiver capable of processing digital radio transmissions and a storage device coupled to the receiver. The user receives the digital transmission and then transmits a request to download content into the storage device when he hears or views the audio or video content which he would like to purchase. This request is sent to a content agent which is an entity responsible for authorizing the sale of the particular content. If the content is not free of charge, the user must also transmit sufficient information to allow for payment of the content. If the payment information is accepted, the content agent transmits a signal to the user authorizing the download of content. The user may then download the content into the storage device which is coupled to the receiver.

The technical advantages of the present invention include providing a method for purchasing and downloading content from a digital radio transmission. In particular, a user can download content from a digital radio transmission into a format wherein the content is both complete and permanent. If the storage device is a portable electronic device or disk drive, the user now has the freedom to enjoy the content regardless of where the receiver is located.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Figure 1:
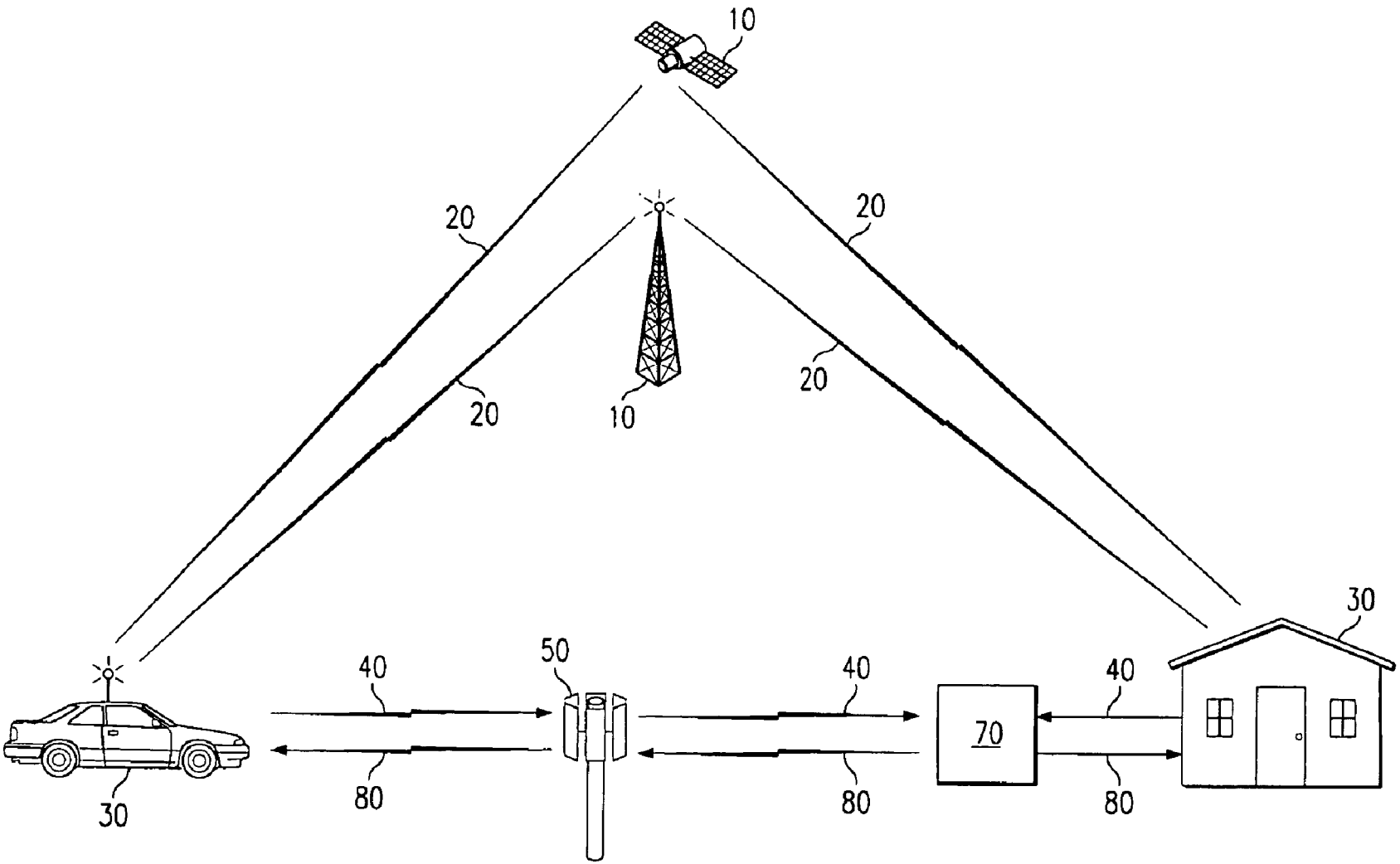
FIG. 1 is a diagram showing the process of transmitting a digital radio signal and downloading and paying for digital radio content.

The preferred embodiments of the present invention and its advantages are best understood by referring now in detail to the figures in which like numeral refer to like elements. FIG. 1 illustrates the transmission of digital radio signals, including content and payment data. Transmission station 10 transmits an in-band on-channel digital audio broadcast (IBOC DAB) signal 20 to user 30. The transmission station 10 is a direct broadcast satellite, or any other transmission facility capable of transmitting a digital radio broadcast. The user 30 is any entity equipped with a receiver capable of processing a digital radio broadcast. Depending on the portability of the user's digital radio receiver, the user may be located in a building, an automobile, or any other location.

A user who has a digital radio receiver can operate the receiver so that the user can listen to or view digital radio broadcasts. In addition to simply passively listening to or viewing the content of the digital radio transmission, user 30 can also download the content of the digital radio broadcast to a local storage device. In this manner, user 30 can capture the content of the digital radio broadcast as the user is listening to or viewing the digital radio transmission. As discussed previously, this content may be audio or video or both. Video includes video, image or other visual data. Examples of possible content include music, music videos, multimedia presentations, images, text, graphs, news, stock market information, traffic information, e-mail or pager communication, talk shows and other audio and/or video material. The audio and/or video content may be coded in any format suitable for digital radio transmission. For example, the content may be coded as MP3, MP4, AAC, Dolby Digital, ePAC, AC3, PCM, MPEG, JPEG or any other suitable coding format or combination thereof. According to one option of the present, a coder decoder is used to convert the content from an analog signal into a digital signal, and this coder decoder may be downloaded before or during the download of content, or may be part of the coded information itself. For example, if the content was AAC coded, the appropriate AAC decoder may be included in the coded content.

In order to capture or download the content of a digital radio transmission, user 30 must first issue a request signal 40 to download the content. User 30 can request to download the content of digital radio signal 20 by issuing a request signal 40 via a cell phone line, a wireless internet connection, or some other method of wireless transmission. Request signal 40 need not be a wireless transmission, however. Request signal 40 could be sent over an existing network, such as the Internet Any necessary payment information is included in request signal 40. Although some digital content may be downloaded with no fee, it is contemplated that some digital content may only be downloaded with payment of a fee. In terms of payment information, user request 40 may include the user's name, credit card number and expiration date. The request signal 40 is transferred to a content agent 70. In the case of a wireless transmission, the request signal 40 may be transferred to content agent 70 through a series of digital transmission nodes 50, such as digital cell towers. In the case of a wired transmission, the request signal 40 may be transferred, for example, through the Internet backbone to content agent 70.

A content agent 70 is an entity that handles the payment for digital content and authorizes the user's downloading of that content. For example, content agent 70 may be the owner of the intellectual property rights in the content, a wholesaler of digital content, a digital content clearinghouse, the digital radio station, or the artist or entity responsible for creating the content. The responsibility for collecting payment, or royalties, for the downloading of a selection of digital content may be distributed among many content agents, each having responsibility and authorization to receive payment for and authorize the downloading of digital content. As an example, the content agents for a particular song or music video may be the radio station, the record company, or a digital content clearinghouse. Any of these content agents can handle the purchase of the right to download the song or music video.

The user may also be able to pay the content agent 70 providing by establishing an account with the content agent. In this manner, the user will have an existing account that content agent 70 can debit following purchases by the users. If the user has an existing account with content agent 70 and wishes to make a purchase on account, as opposed to a credit card purchase, the user will specific the account number and password. The user may also pay with prepaid cards or smart cards. Prepaid cards are purchased by the user and represent a certain number of purchases or a currency amount. After making the purchase, the account associated with the card is debited or the card is rewritten to reflect the new balance following the transaction After content agent 70 has processed the user's payment information, whether in the form of a credit card or an existing account, content agent 70 sends a response signal 80 to user 30. Response signal 80 will indicate whether content agent 70 has accepted or rejected the download request. Like request signal 40, response signal 80 is transmitted via a wireless network or through an existing network, such as the Internet.

Figure 2:
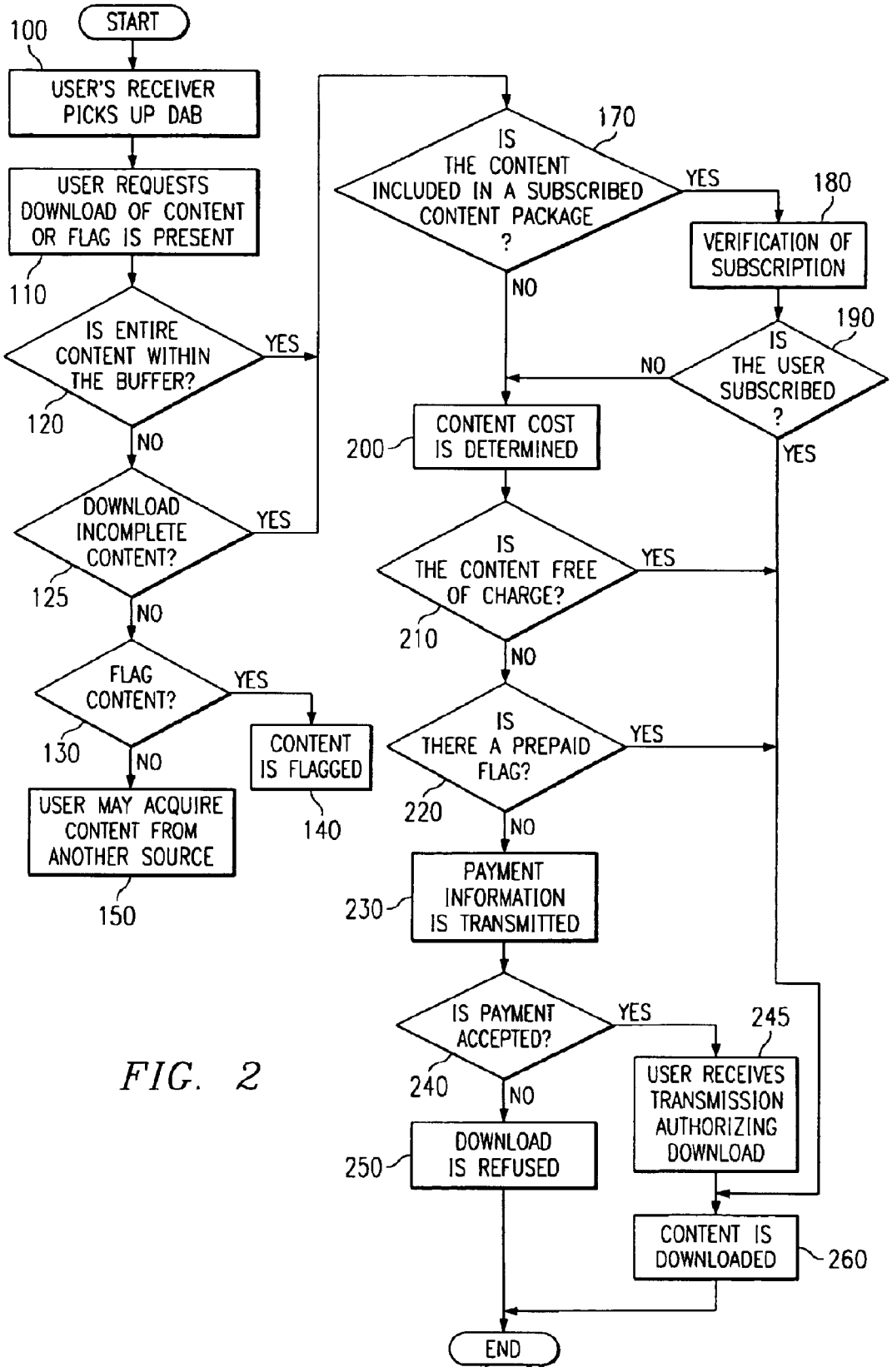
FIG. 2 is a flow chart for downloading radio content and transmitting any necessary payment information.

FIG. 2 is a flow chart depicting the process of receiving a digital radio broadcast, downloading content and providing for any necessary payment information. At step 100, the user tunes his digital receiver to the station of a particular IBOC DAB signal. The digital receiver of the present invention includes a tuner and a numeric keypad, touch sensitive video monitor or other means of entering payment information, such as a card reader. The digital receiver may also include a display screen for displaying text, images, graphics or video associated with the digital radio content Alternatively, the digital receiver may be linked to a computer such that the computer keyboard and monitor serve as the numeric keypad and display screen, respectively. The digital receiver may also contain a local memory buffer. As such, the digital receiver of the present invention is capable of receiving and storing an IBOC DAB signal. The digital receiver is also coupled an auxiliary storage device that may contain a greater memory capacity than the memory buffer. The memory buffer stores the digital radio content which has been transmitted to the receiver. The amount of content stored depends on the storage capacity of the memory buffer or the auxiliary storage device.

The memory buffer is always active, and stores the most recent content received by the digital receiver without regard to whether the user has received an authorization to download the content. For example, if a memory buffer is sized to store thirty minutes of digital content, the memory buffer of the receiver will store the most recent thirty minutes of digital radio content. As long as the receiver is receiving a digital radio transmission, the memory buffer will be continuously updated. The memory buffer will save the digital signal for the station to which the digital signal is tuned. The memory buffer receives and stores digital content even if the central power switch to the digital receiver unit is turned off. In the case of a digital receiver that is located in an automobile, the memory buffer will continuously store the most recent digital content so long as it receives backup power from the car's battery. In the case of a digital receiver that is plugged into a standard wall outlet, the memory buffer will continue to store the most recent digital content so long as the digital receiver receives backup power from the wall outlet. The memory buffer may be set to save a length of digital content that is less than its maximum storage capacity. Suitable memory buffers or auxiliary storage devices include portable devices capable of storing and playing or displaying digital audio and/or video material in MP3, MP4, AAC, Dolby Digital, ePAC, AC3, PCM, MPEG, JPEG or any other suitable coding format, hard drives, CD-R, DAT, or disk drives and other devices capable of storing digital information.

Upon hearing or viewing a desirable digital signal, such as a song or news broadcast, the user may then request that the content be downloaded in step 110. As an alternative to issuing an immediate download request, the user may choose to flag the digital selection. Each digital selection of each digital signal includes identifying data In the case of a song or music video, the identifying data will include the name of the song, artist, record company, and a unique number of code to distinguish the selection. Once a digital selection is flagged, the identification information corresponding to the flagged content is stored in the memory of the receiver. The user may choose to flag a digital selection when, for example, only a portion of the digital selection is present in the memory buffer. The user may also flag a digital selection when the user wants to make a note of the selection but does not wish to download and pay for the selection. According to one option of the present invention, the digital receiver may be set to issue an automatic download request if the digital receiver receives a digital selection that has been previously flagged by the user. The user can also flag or select for downloading any digital content that is present in the memory buffer of the digital receiver.

After a request to download content has been issued at step 110, it is determined at step 120 whether the selected digital content is within the memory buffer. For example, in the event the user turns on the receiver in the middle of a song or music video he wishes to download, the memory buffer, depending on its size, may have stored the entirety of the song or selection, thereby allowing the user to download the entire digital selection At step 125, the user may choose to download an incomplete selection of digital content. Downloading an incomplete selection may be a worthwhile option when the digital content or selection is an exclusive or one-time only transmission. If the digital selection is incomplete, it may be available at an adjusted cost.

If the user does not choose to download an incomplete selection at step 125, the user may flag the content for future downloading at step 130. If the user chooses to flag the content at step 140, the digital receiver will recognize the content the next time that it is received in the memory buffer and will send an automatic download request to content agent 70. The user may choose to pay for the content in advance, in which case the flag is designated as a prepaid flag, causing the content to be automatically downloaded when the content is next transmitted.

If the entire digital content is not present in the memory buffer, and the user has chosen not to flag the digital selection or download an incomplete selection, the user may choose at step 150 to acquire the content from a source other than the digital radio transmission. For example, each digital selection of each digital signal may also include, in addition to identifying data, information regarding content agent 70 sufficient to allow a request signal 40 to be sent to content agent 70. As discussed previously, transmitting and processing payment information can be accomplished in several ways. However, in addition to sending response signal 80, content agent 70 also transmits the requested content to the user electronically. Thus, user 30 must transmit information along with request signal 40 sufficient to allow content agent 70 to successfully transmit the content to user 30. Like response signal 80, the content may be transmitted via a wireless network or through an existing network like the Internet. In a similar fashion, the user may choose to acquire content that is associated with the digital radio content but that is not being transmitted. Content that is considered to be associated with the digital radio content includes content created by the same content provider, content which is related in subject matter, content that that can be presented together in the sense of an encompassing work or performance or any content that is otherwise commercially or artistically connected or related to the digital radio content. In the case of a song, information accompanying the digital selection may allow the user to send a request signal 40 and payment information for the entire album on which the song appears. After the payment information has been sent and processed, the content agent 70 may then transmit the entire album to the user via a wireless network or through an existing network like the Internet.

If the user chooses to download a complete or incomplete selection, then it is determined at step 170 whether the digital selection is part of a subscribed content package. If the content is included in a subscribed content package, then it is determined in step 180 whether the user is subscribed. A user may choose to pay for certain regularly occurring content in advance. There are a number of ways to verily the user's subscription status. For example, upon subscribing the user may receive a special prepaid card or smartcard which has stored a selected amount of credit which allows him to download a predetermined amount of content or an account number which can be used to authorize a download of subscribed content. Alternatively, the serial or identification number of his receiver, portable audio device capable of storing and playing digital coded audio material such as an MP3 player or any other device which the user chooses to download content with may be used to verify his subscription. If it is determined that the user is subscribed in step 190, the content is downloaded in step 260. Payment for such subscription content can be made in advance by the payment methods discussed above, including credit card payment, payment with prepaid cards or smart cards, or payment through an existing account.

If the user is not subscribed or the content is not included in a subscribed content package, then the cost of the content must be determined in step 200. If the content is determined to be free of charge in step 210, the content is downloaded in step 260. If the digital content is determined to be not free of charge, it is determined at step 220 whether a prepaid flag exists for the digital selection. If a prepaid flag is determined to exist, the content is downloaded immediately at step 260.

At step 230, after it is has been determined at step 220 that there is not a prepaid flag for the digital selection, payment information is transmitted to the content agent 70. As discussed previously, transmitting and processing payment information can be accomplished in several ways. The credit card number or prepaid card number of the user may be transmitted over a wireless connection, such as a cellular telephone line or a wireless Internet connection. Alternatively, such information could be transferred by an established network connection such as though the Internet. If the user has an account with a content agent, the user's account number and password can be transmitted by any suitable wireless or networked connection to the content agent 70.

Once the payment information has been transmitted in step 230, it is determined at step 240 whether payment is accepted by the content agent. If the user chooses to charge the cost of the content download to a smart or prepaid card the card must contain sufficient credit to allow for the purchase of the requested content. If the payment is accepted, then the user will receive a transmission authorizing the download of the content in step 245. Once the user receives this authorization in step 245, the content is downloaded to the user's storage device in step 260. If the payment is not accepted, the download request is rejected in step 250. The downloaded content is stored in an auxiliary storage device. Such storage devices may include portable devices capable of storing and playing or displaying digital audio and/or video material in MP3, MP4, AAC, Dolby Digital, ePAC, AC3, PCM, MPEG, JPEG or any other suitable coding format, hard drives, CD-R, DAT, or disk drives and other devices capable of storing digital information.

Because the system and method of the present invention requires that the user request authorization from a content agent in order to successfully download the selected content, the content provider's intellectual property rights in the content are protected in this initial transfer of the content. However, content providers are also concerned with the distribution of digital versions of their content beyond the initial purchase. For example, the Secured Digital Music Initiative was formed in response to concerns that digital coded audio formats such as MP3 may foster digital piracy. Due to the relative ease with which high quality digital versions of music content can be transmitted to several entities and stored without degradation in quality or the payment of royalties, it is desirable to secure the digital content of the digital radio transmissions from digital piracy. One method of protecting digital content from piracy is the use of a watermark A watermark is a signal embedded in the content and is encoded in such a way as to be inaudible and otherwise undetectable. This watermark identifies the owner of the content in which the watermark in embedded. If the watermarked content is copied too many times, the watermark will be wiped out since it is a relatively weak signal. Therefore, digital content which does not have a watermark may be presumed to be an unauthorized copy. Since the content of a digital radio transmission is digital, it can be watermarked. The content agent can ensure that the content of the digital radio transmission, or any other content which the user requests to download, is watermarked. Other methods of protecting against digital piracy include the use of encryption. The content may be encrypted such that the user must purchase a key in order to decode and download the content. Thus the system and method of the present invention allows the content provider to both protect its intellectual property rights in the initial transaction and detect the unauthorized digital dissemination of the content.

The system and method of the present invention permits the user to listen to digital content and selectively download the content. As such, the user will have immediate access to digital content heard or viewed over digital radio stations. The user can build a library of such content, and, as a result of the payment scheme disclosed herein, the owners of such content are fairly compensated for the user's acquisition of the content. The present invention permits the user to listen to or view digital content before the user makes the decision to purchase the content The user can set flags that will monitor the digital signals for certain content and automatically download the content upon its next transmission to the digital receiver. In sum, the present invention permits users to acquire and archive digital radio content through purchases made simultaneously with the transmission of the content or at some later time.

Although the disclosed embodiments have been described in detail, it should be understood that various changes, substitutions and alterations can be made to the embodiments without departing from their spirit and scope.

What is claimed is:

1. A method for downloading and paying for content selected from a digital radio transmission, the digital radio transmission including discrete content segments, comprising the steps of:

providing a receiver capable of processing digital radio transmissions, wherein the receiver includes a buffer suitable for storing a selected time period of the digital radio transmission, and a storage device coupled to the receiver;

receiving a first digital radio transmission;

storing a selected time period of the first digital radio transmission;

placing a flag on a discrete content segment of the digital radio transmission;

transmitting a request to download the discrete content segment associated with the flag;

transmitting payment information sufficient to allow for payment of the discrete content segment associated with the flag;

receiving a transmission authorizing the download of the content;

receiving a second digital transmission comprising the discrete content segment associated with the flag;

recognizing that the second digital transmission include the discrete content segment associated with the flag; and downloading the discrete content segment associated with the flag to the storage device.

2. The method for downloading and paying for content selected from a digital radio transmission of claim 1, wherein the step of transmitting a request to download the content comprises the step of transmitting a request to a content agent to download content, the content agent able to initiate the downloading of the content.

3. The method for downloading and paying for content selected from a digital radio transmission of claim 1, wherein the storage device is a digital storage device.

4. The method for downloading and paying for content selected from a digital radio transmission of claim 3, wherein the digital storage device is a portable electronic device.

5. The method for downloading and paying for content selected from a digital radio transmission of claim 1, wherein the content is coded in a format suitable for digital radio transmission.

6. The method for downloading and paying for content selected from a digital radio transmission of claim 5, wherein the content is coded in or compatible with MP3, MP4, AAC, Dolby Digital, ePAC, AC3, PCM, MPEG, or JPEG format or any combination thereof.

7. The method for downloading and paying for content selected from a digital radio transmission of claim 1, wherein the download request transmission is a wireless transmission.

8. The method for downloading and paying for content selected from a digital radio transmission of claim 7, wherein the wireless transmission is over cellular telephone lines.

9. The method for downloading and paying for content selected from a digital radio transmission of claim 1, wherein the download request transmission is made over an Internet connection.

10. The method for downloading and paying for content selected from a digital radio transmission of claim 1, wherein the content includes video content.

11. A method for downloading and paying for content selected from a digital radio transmission received by a receiver capable of processing digital radio transmissions and coupled to a storage device, comprising the steps of:

receiving the digital radio transmission at the receiver;

transmitting a request to transmit the content for the purpose of downloading the content to the storage device, the content requested not included in the digital radio transmission but associated with the content which is transmitted in the digital radio transmission;

transmitting information sufficient to allow for payment of the content;

transmitting the requested content;

receiving the transmission of the requested content; and downloading the requested content to the storage device.

12. A method for downloading and paying for content selected from a digital radio transmission comprising the steps of:

providing a receiver capable of receiving digital radio transmissions and a storage device coupled to the receiver;

receiving the digital radio transmission at the receiver;

transmitting a request to download the content;

transmitting information sufficient to allow for payment of the content;

receiving a transmission authorizing the download of the content;

downloading the content to the storage device;

downloading a decoder capable of converting the downloaded content to an analog signal to the storage device; and playing the downloaded content at the receiver using the downloaded decoder by converting the downloaded content to an analog signal.

* * * * *